US005857410A

United States Patent [19]

Watanabe et al.

[11] Patent Number: 5,857,410

[45] Date of Patent: Jan. 12, 1999

[54] PRINTING APPARATUS FOR SELECTIVELY SUPPLYING A PHOTOTHERMAL MATERIAL/COLORANT TO A STENCIL OR SUBSTRATE

[75] Inventors: Hideo Watanabe; Junnosuke Katsuyama, both of Inashiki-gun, Japan

[73] Assignee: Riso Kagaku Corporation, Tokyo, Japan

[21] Appl. No.: 725,509

[22] Filed: Oct. 4, 1996

[30] Foreign Application Priority Data

Oct. 5, 1995 [JP] Japan ..... 7-284611

[51] Int. Cl.[6] ..... B41C 1/14; B41L 13/06; B41F 15/10

[52] U.S. Cl. ..... 101/116; 101/115; 101/128.21; 101/128.4; 101/129

[58] Field of Search ..... 101/115, 116, 101/118, 128.21, 128.4, 129, 401.1, 467; 347/2, 95, 100

[56] References Cited

U.S. PATENT DOCUMENTS

| | | | |
|---|---|---|---|
| 4,139,759 | 2/1979 | Hayama et al. | 219/216 |
| 4,423,676 | 1/1984 | Neel | 101/116 |
| 4,504,553 | 3/1985 | Aubert et al. | 428/622 |
| 5,156,089 | 10/1992 | McCue et al. | 101/128.4 |
| 5,312,654 | 5/1994 | Arimatsu et al. | 347/95 |
| 5,339,737 | 8/1994 | Lewis et al. | 101/457 |
| 5,483,883 | 1/1996 | Hayama | 101/128.21 |
| 5,655,446 | 8/1997 | Watanabe | 101/128.21 |
| 5,662,039 | 9/1997 | Watanabe et al. | 101/128.4 |

FOREIGN PATENT DOCUMENTS

| | | | |
|---|---|---|---|
| 0 635 362 A1 | 1/1995 | European Pat. Off. . | |
| 0 648 615 A1 | 4/1995 | European Pat. Off. . | |
| 0 710 552 | 5/1996 | European Pat. Off. . | |
| 36804 | 3/1979 | Japan | 101/128.21 |
| 284490 | 12/1986 | Japan | 101/128.21 |
| 111742 | 5/1987 | Japan | 101/128.21 |
| 2220815 | 1/1990 | United Kingdom . | |

*Primary Examiner*—Stephen R. Funk
*Attorney, Agent, or Firm*—Pillsbury Madison & Sutro LLP

[57] ABSTRACT

The disclosed printing apparatus is includes an ink-permeable cylindrical printing drum which is rotated about an axis of rotation thereof with a heat-sensitive stencil sheet wound around the circumferential surface thereof; a liquid ejector which ejects a photothermal conversion material contained in a liquid to the heat-sensitive stencil sheet in accordance with image information, so that the photothermal conversion material is transferred to the stencil sheet as a reproduction of the image; a light which radiates a visible or infrared ray to the stencil sheet to which the photothermal conversion material has been transferred, such that the stencil sheet is perforated by heat emitted by the photothermal conversion material; and a presser which presses at least either the printing drum or printing sheet that is being moved in synchrony with the rotation of the printing drum, bringing the drum and printing sheet into close contact with each other, such that the stencil printing ink that is fed into the printing drum is transferred to the printing sheet through the perforated stencil sheet, in which the liquid ejector is further capable of ejecting a photothermal conversion material and/or a colorant contained in a liquid directly to the printing sheet in accordance with the desired image information, such that the image can be reproduced directly onto the printing sheet. Printing can be effected by two modes either stencil printing or printing directly from the liquid ejector. Upon perforation, the stencil sheet is not required to contact any substance, such as an original or a thermal printer head.

7 Claims, 3 Drawing Sheets

PRINTING APPARATUS FOR SELECTIVELY SUPPLYING A PHOTOTHERMAL MATERIAL/COLORANT TO A STENCIL OR SUBSTRATE

BACKGROUND OF THE INVENTION

The present invention relates to a printing apparatus which can efficiently print both large and small numbers of copies in two different printing modes.

The so-called "digital printing machine" is currently popular as this printing machine combines high printing speed with low operating cost. In the digital printing machine, a heat-sensitive stencil sheet comprising a thermoplastic film is molten and perforated by a heating means, such as a thermal head which emits heat as a pattern of dots in accordance with the desired image information including letters, figures and photographs, having previously been converted to electrical signals. Thereafter, the stencil sheet is wound around a printing drum containing stencil printing ink therein to transfer the printing ink through perforations of the stencil sheet onto printing paper.

However, when the stencil sheet is perforated in the digital printing machine, problems arise, including deficient perforations, failure of conveyance of stencil sheets and wrinkling of the stencil sheet due to exertion of uneven pressure upon pressing the stencil sheet to the thermal head.

Furthermore, while the conventional digital printing machine is useful for printing a large number of copies, the machine is expensive when used to generate a small number of copies.

Under the circumstances, a possibly remedy to the problem would be a printing machine equipped with heat-sensitive recording paper or thermal transfer recording paper for printing a small number of copies. However, these modifications would require a larger printing machine, and would complicate the operation of the printing machine, since both printing paper and recording paper must be ready for use in the modified printing machine.

An alternative printing machine has been proposed, in which one kind of regular paper can be printed by an electrophotographic process when a small number of copies are made, and by a stencil priming process when a large number of copies are needed. However, the printing system as a whole would be costly and unduly large in size.

Furthermore, when color printing is effected by the digital printing machine, a plurality of printing drums each containing stencil printing ink of a different color is required. The plurality of drums may be interchanged with one another in the printing machine when printing is effected in different colors on different regions of paper. However, implementation of the interchange is difficult, thereby reducing operating efficiency.

SUMMARY OF THE INVENTION

It is an object of the present invention to provide a printing apparatus which overcomes the above-mentioned problems, by efficiently producing both large and small numbers of printed copies at a relatively low operating cost even in color, and is small in size.

Hereinafter, the present invention will be explained in more detail by way of a presently-preferred embodiment with reference to the accompanying drawings.

Figure 1A:
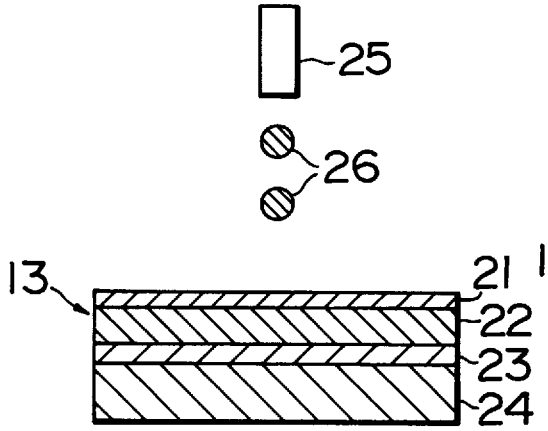
FIG. 1A is a sectional side view of the printing apparatus, a state of the apparatus in which a liquid containing a photothermal conversion material is ejected from a liquid ejecting means to a liquid absorbing layer of a heat sensitive stencil sheet.
Figure 1B:
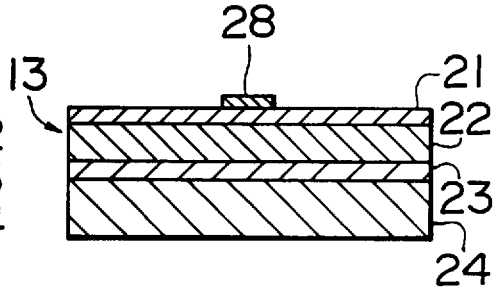
FIG. 1B is a sectional side view of the printing apparatus, showing a photothermal conversion material transferred onto a heat-sensitive stencil sheet.

It should be clearly understood that the following embodiment is presented only for illustrative purposes, and that the present invention is not limited to the embodiment.

DETAILED DESCRIPTION OF THE DISCLOSURE

According to the above object, the present invention provides a printing apparatus comprising an ink-permeable cylindrical printing drum which is rotated about an axis of rotation thereof with a heat-sensitive stencil sheet wound around the circumferential surface thereof; a liquid ejecting means which ejects a photothermal conversion material contained in a liquid to the heat-sensitive stencil sheet in accordance with the desired image information, such that the photothermal conversion material is transferred to the stencil sheet as a reproduction of the image; a light radiating means which radiates a visible or an infrared ray to the stencil sheet to which the photothermal conversion material has been transferred, such that the stencil sheet is perforated by heat emitted by the photothermal conversion material; and a pressing means which presses at least either said printing drum or said printing sheet that is moving in synchrony with the rotation of the printing drum, bringing the printing drum and printing sheet into close contact with each other, such that the stencil printing ink that is fed into the printing drum is transferred to the printing sheet through the perforated stencil sheet, in which said liquid ejecting means is further capable of ejecting a photothermal conversion material and/or a colorant contained in a liquid directly to the printing sheet in accordance with the desired image information, such that the image can be reproduced directly onto the printing street.

The first feature of the present printing apparatus, in which a stencil sheet perforation system unique from the conventional rotary stencil printing apparatus is used, involves a method for perforating a heat-sensitive stencil sheet, comprising a first step of transferring a photothermal conversion material to a heat-sensitive stencil sheet by ejecting a liquid which contains the photothermal conversion material, from a liquid ejecting means to the heat-sensitive stencil sheet, and a second step of perforating the heat-sensitive stencil sheet specifically at sites to which the photothermal conversion material has been transferred, by subjecting the stencil sheet to a visible or an infrared ray.

The liquid ejecting means may be a device comprising an ejecting head of nozzles, slits, porous materials, porous films or the like providing 10 2000 openings per inch (i.e., 10 to 2000 dpi) and connected to piezoelectric elements, heating elements, liquid-conveying pumps or the like so as to eject the liquid containing the photothermal conversion material intermittently or continuously, in the form of dots or lines, in accordance with the electrical signals for letters or images.

The first step of the perforating method can be practiced, for example, by controlling a liquid ejecting means to eject the liquid from an ejecting head onto a heat sensitive stencil sheet while the liquid ejecting head is located a slight distance apart from the heat-sensitive stencil sheet and moved parallel to the stencil sheet in accordance with image data that have previously been transformed into electrical signals, and then evaporating the liquid that has been transferred to the heat-sensitive stencil sheet, such that the image is reproduced on the surface of the heat-sensitive stencil sheet as solid adherents mainly composed of the photothermal conversion material.

In the second step of the perforating method, when a visible or infrared ray is radiated to the heat-sensitive stencil sheet to which a photothermal conversion material has been transferred, the photothermal conversion material absorbs light to emit heat. As a result, the thermoplastic film of the heat-sensitive stencil sheet is molten and perforated to obtain a master for stencil printing directly from the stencil sheet itself. The visible or infrared ray can readily be radiated using xenon lamps, flash lamps, halogen lamps, infrared heaters or the like.

Accordingly, the perforating method does not require stencil sheet to contact any substance, such as an original or thermal head to make a master, but requires only that the stencil sheet be exposed to a visible or an infrared ray. Thus, no wrinkling of stencil sheet occurs upon making a master.

In the present invention, both the first step and the second step mentioned above may be conducted before the heat-sensitive stencil sheet is wound around the priming drum or after the heat-sensitive stencil sheet has been wound around the printing drum.

The second feature of the present invention is that the printing apparatus is a printing apparatus which can effect printing in two modes, i.e., stencil printing and jet printing, by enabling the liquid ejecting means to further eject a photothermal conversion material and/or a colorant contained in a liquid directly to a printing sheet, such as printing paper and a plastic sheet in accordance with image information, such that the image can be reproduced directly on the printing sheet.

In the present printing apparatus, the liquid ejecting means may comprise a single ejecting head which can selectively turn to a heat-sensitive stencil sheet or a printing sheet to eject the photothermal conversion material to both of them, or may comprise a plurality of ejecting heads, one of which ejects the photothermal conversion material to a heat-sensitive stencil sheet and another of which ejects the photothermal conversion material and/or a colorant to a printing sheet. Furthermore, in order to make multicolor printing possible, the liquid ejecting means may have a plurality of ejecting heads, each of which ejects a colorant of different colors to a printing sheet, or may have a single ejecting head which can eject a plurality of colorants of different colors to a printing sheet.

In the present printing apparatus, a large number of copies can be printed via stencil printing by ejecting a photothermal conversion material from a liquid ejecting means to a heat-sensitive stencil sheet and perforating the stencil sheet by use of a light radiating means, and a small number of copies may be readily printed by ejecting a photothermal conversion material and/or a colorant from the liquid ejecting means directly to a printing sheet. Thus, printing of both a small number and a large number of copies can be efficiently achieved by controlling the liquid ejecting means in the printing apparatus, using only one type of printing sheet with the heat-sensitive stencil sheet in the printing apparatus. The liquid ejecting means may also eject a photothermal conversion material and/or a colorant to a sheet that has been printed by stencil printing, enabling overlay priming or multicolor priming. Furthermore, printing in black, which is frequently required, may be achieved by stencil printing, and printing in blue, red and yellow, which is not frequently in demand, may be effected by printing directly from the liquid ejecting means, thereby increasing the efficiency of color printing.

The photothermal conversion material used in the present invention can transform light energy into heat energy, and preferably comprises materials efficient in photothermal conversion, such as carbon black, lampblack, silicon carbide, carbon nitride, metal powders, metal oxides, inorganic pigments, organic pigments, and organic dyes. Particularly preferred materials are those having a high light absorbency within a specific range of wavelengths, such as phthalocyanine colorings, cyanine colorings, squalirium colorings, and polymethine colorings.

The colorant used in the present invention may be the same as the photothermal conversion material if the color of the former is the same as that of the latter. Examples of the colorant are organic or inorganic pigments such as furnace carbon black, lampblack, phthalocyanine blue, Victoria blue, Brilliant Carmine 6B, Permanent Red F5R, Rhodamine B Lake, Benzidine Yellow, Hansa Yellow, Naphthol Yellow, titanium oxide and calcium carbonate, and dyes such as of azo, anthraquinone, quinacridone, xanthene and acridine.

The liquid in which the above photothermal conversion material or the above colorant is contained may be a solvent such as an aliphatic hydrocarbon, an aromatic hydrocarbon, an alcohol, ketone, ester, ether, aldehyde, carboxylic acid, or amine, a low molecular weight heterocyclic compound, an oxide, and water. More specific examples thereof are hexane, heptane, octane, benzene, toluene, xylene, methyl alcohol, ethyl alcohol, isopropyl alcohol, n-propyl alcohol, butyl alcohol, ethylene glycol, diethylene glycol, propylene glycol, glycerin, acetone, methyl ethyl ketone, ethyl acetate, propyl acetate, ethyl ether, tetrahydrofuran, 1,4-dioxane, formic acid, acetic acid, propionic acid, formaldehyde, acetaldehyde, methylamine, ethylene diamine, dimethylformamide, pyridine, and ethylene oxide. These liquids may be used alone or in combination, and are preferably those which evaporate quickly after transfer from the liquid ejecting means to the heat-sensitive stencil sheet. To the liquid may be added dyes, pigments, fillers, binders, hardening agents, preservatives, wetting agents, surfactants, pH-adjusting agents, or the like, as required.

Thus, a composition for perforating a heat-sensitive stencil sheet and a colorant composition can be prepared by appropriately dispersing or mixing the above photothermal conversion material and/or the above colorant in or with the above liquid in a form readily ejectable from the liquid ejecting means.

The heat-sensitive stencil sheet used in the present invention may be a stencil sheet, at least one side of which is suitable for the transfer of photothermal conversion material and which can be molten and perforated by the heat emitted by the photothermal conversion material. The stencil sheet may be made of a thermoplastic film only, or may be a thermoplastic film laminated to a porous substrate.

The thermoplastic film comprises a film made from polyethylene, polypropylene, polyvinylchloride, polyvinylidene chloride, polyethylene terephthalate, polybutylene terephthalate, polystyrene, polyurethane, polycarbonate, polyvinyl acetate, acrylic resins, silicone resins, and other resinous compounds. These resinous compounds may be used alone, in combination, or as a copolymer. Suitable thickness of the thermoplastic film is 0.5–50 $\mu$m, preferably 1–2 $\mu$m. Films with less than 0.5 $\mu$m in thickness, are inferior in workability and strength. Films greater than 50 $\mu$m in thickness are not economical, as they require a great amount of heat energy for perforation.

The above porous substrate may be a thin paper, a nonwoven fabric, a gauze or the like, which is made from natural fibers such as Manila hemp, pulp, Edgeworthia, paper mulberry and Japanese paper, synthetic fibers such as of polyester, nylon, vinylon and acetate, metallic fibers, or glass fibers, alone or in combination. Basis weight of these porous substrates is preferably 1–20 g/m$^2$, more preferably 5–15 g/m$^2$. Stencil sheets less than 1 g/m$^2$ are weak, while more than 20 g/m$^2$ causes stencil sheets to have inferior ink permeability upon printing. Thickness of the porous substrate is preferably 5–100 $\mu$m, more preferably 10–50 $\mu$m. If the thickness is lower than 5 $\mu$m, stencil sheets are weak. At a thickness greater than 100 $\mu$m, stencil sheets are often inferior in ink permeability upon printing.

The heat-sensitive stencil sheet used in the present invention preferably has a liquid absorbing layer laminated to the stencil sheet on a side onto which the liquid is ejected, which prevents the liquid from blurring on the stencil sheet and may accelerate drying of the liquid on the stencil sheet. Under these conditions, perforations faithful to the original image are obtained when the stencil sheet is exposed to light, and thus sharp images can be printed.

The liquid absorbing layer is preferably formed on the outermost surface of the stencil sheet as a resinous layer which is molten end perforated similarly to the thermoplastic film when the stencil sheet is exposed to light to obtain a master. The liquid absorbing layer can be made of any material, providing the material prevents the liquid from blurring in the planar direction and fixes the photothermal conversion material on the stencil sheet. Preferably, the liquid absorbing layer comprises a material with high affinity for the above-mentioned liquid. For example, if the liquid is aqueous, the liquid absorbing layer may be made of polymer compounds such as polyvinyl alcohol, methyl cellulose, carboxymethyl cellulose, hydroxyethyl cellulose, polyvinyl pyrrolidone, ethylene-vinyl alcohol copolymers, polyethylene oxide, polyvinyl ether, polyvinyl acetal, and polyacrylamide. These resinous compounds may be used alone, in combination or as a copolymer. If the liquid is an organic solvent, the liquid absorbing layer may comprise polymer compounds such as polyethylene, polypropylene, polyisobutylene, polystyrene, polyvinylchloride, polyvinylidene chloride, polyvinyl fluoride, polyvinyl acetate, acrylic resins, polyamide, polyimide, polyester, polycarbonate, and polyurethane. These resinous compounds may be used alone, in combination, or as a copolymer.

Further, organic or inorganic particulates may be added to the liquid absorbing layer. Such particulates may include organic particulates of polyurethane, polyester, polyethylene, polystyrene, polysiloxane, phenol resin, acrylic resin, and benzoguanamine resin, and inorganic particulates of, for example, talc, clay, calcium carbonate, titanium oxide, aluminum oxide, and kaolin.

The liquid absorbing layer can be obtained by applying a liquid containing the above polymer compound and if necessary the above particulate, to a stencil sheet by use of a coating means, such as a gravure coater and a wire bar coater, followed by drying.

The heat-sensitive stencil sheet used in the present invention preferably has a light reflecting layer which reflects visible or infrared rays, in order to prevent light energy from being converted to heat at portions of stencil sheet to which no photothermal conversion material is transferred. Under these circumstances, only image portions where the photothermal conversion material is transferred are perforated, leaving non-image portions unaffected. Thus, perforated heat-sensitive stencil sheets can be generated without so-called "pin-holes".

The light reflecting layer may be formed as a metal film by vacuum deposition of a metal on the above thermoplastic film, or may be formed by applying a liquid containing a metal powder and a polymer compound of the above thermoplastic film onto the thermoplastic film of the stencil sheet by use of a coating means such as a gravure coater and a wire bar coater, followed by drying. The metal is preferably highly respective, such as gold, aluminum and tin.

When the light reflecting layer is a metal film vacuum-deposited on stencil sheet, the thermoplastic film of the stencil sheet is molten upon exposure to light, causing the metal film to lose its supporting structure and to detach therefrom at portions where the photothermal conversion material has been transferred, causing perforations in the stencil sheet. When the light reflecting layer is made from a mixture of metal powders and polymer compounds, the thermoplastic film of the stencil sheet and the light reflecting layer are simultaneously molten upon exposure to light in areas where the photothermal conversion material has been transferred, such that perforations are created in the stencil sheet.

When the light reflecting layer and the liquid absorbing layer are both laminated to the present stencil sheet, the liquid absorbing layer may be laminated onto the light reflecting layer, or the light reflecting layer may be laminated onto one side of the thermoplastic film of the stencil sheet, while the liquid absorbing layer is laminated onto the other side of the thermoplastic film.

Upon printing, the perforated heat-sensitive stencil sheet is wound around the circumferential surface of an ink-permeable cylindrical printing drum that is rotated about an axis of rotation thereof, as in the conventional rotary stencil printing apparatus. Printing is effected by allowing printing ink that has been fed into the inner wall of the printing drum to pass through the perforated portions of the stencil sheet and transfer to the printing sheet with the aid of a pressing means, which presses either the rotating printing drum or the printing sheet which is moved in synchrony with the rotation of the printing drum, so as to bring the printing sheet into close contact with the printing drum by way of the stencil sheet wound therearound.

The pressing means may be, for example, a press roller which is located outside and opposite to the printing drum and can press the exterior circumferential wall of the drum, or may be a squeeze roller or blade which is located inside and tangential to a flexible circumferential wall of the printing drum and can extend the wall of the drum outwardly to press it onto another cylindrical drum located outside and opposite to the printing drum.

The printing ink that is fed into the inside of the printing drum may be any ink conventionally used in stencil printing, such as oil ink, aqueous ink, water-in-oil (W/O) emulsion ink, oil-in-water (O/W) emulsion ink, and heat-meltable ink.

EXAMPLES

FIG. 1 illustrates a mechanism of perforating a stencil sheet in the claimed priming apparatus. FIG. 1A shows a heat-sensitive stencil sheet 13 which has a four-layer structure consisting of a liquid absorbing layer 21, a thermoplastic film 22, a light reflecting layer 23 and a porous substrate 24. A liquid 26 containing a photothermal conversion material is ejected from an ejecting head 25 of a liquid ejecting means to the liquid absorbing layer 21 of the stencil sheet 13 in the form of letter images, such that the photothermal conversion material 28 is transferred onto the stencil sheet 13 as shown in FIG. 1B.

Figure 1C:
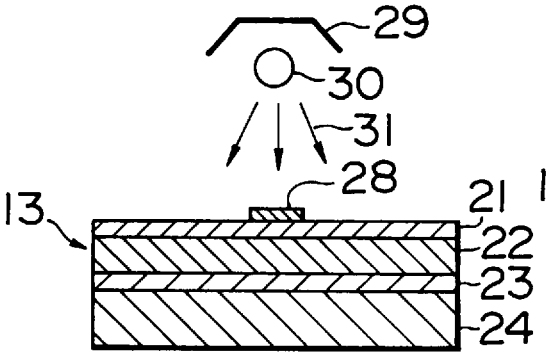
FIG. 1C is a sectional side view of the printing apparatus, irradiation of a heat-sensitive stencil sheet onto which a photothermal conversion material has been transferred.
Figure 1D:
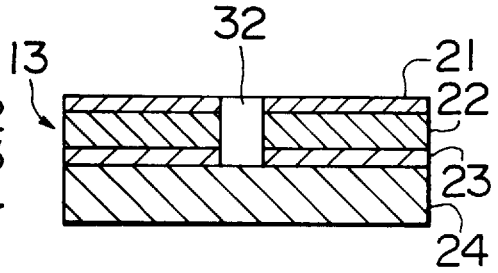
FIG. 1D is a sectional side view of the printing apparatus, illustrating perforation of a heat-sensitive stencil sheet after exposure to light.

Thereafter, a visible or infrared ray 31 is directed by a light radiating means 30 having a light reflector 29 to the stencil sheet in the region of the letter image formed by the transferred and fixed photothermal conversion material 28, as shown in FIG. 1C. While the radiated ray 31 is reflected by the light reflecting layer 23 from areas other than region with the letter image, only areas to which the photothermal conversion material 28 has been fixed emit heat. Thus, the liquid absorbing layer 21 and the thermoplastic film 22 are molten, and the light reflecting layer 23 is detached or molten to form a perforation 32 in the stencil sheet specifically at the site where the photothermal conversion material is fixed, as shown in FIG. 1D.

Figure 2:
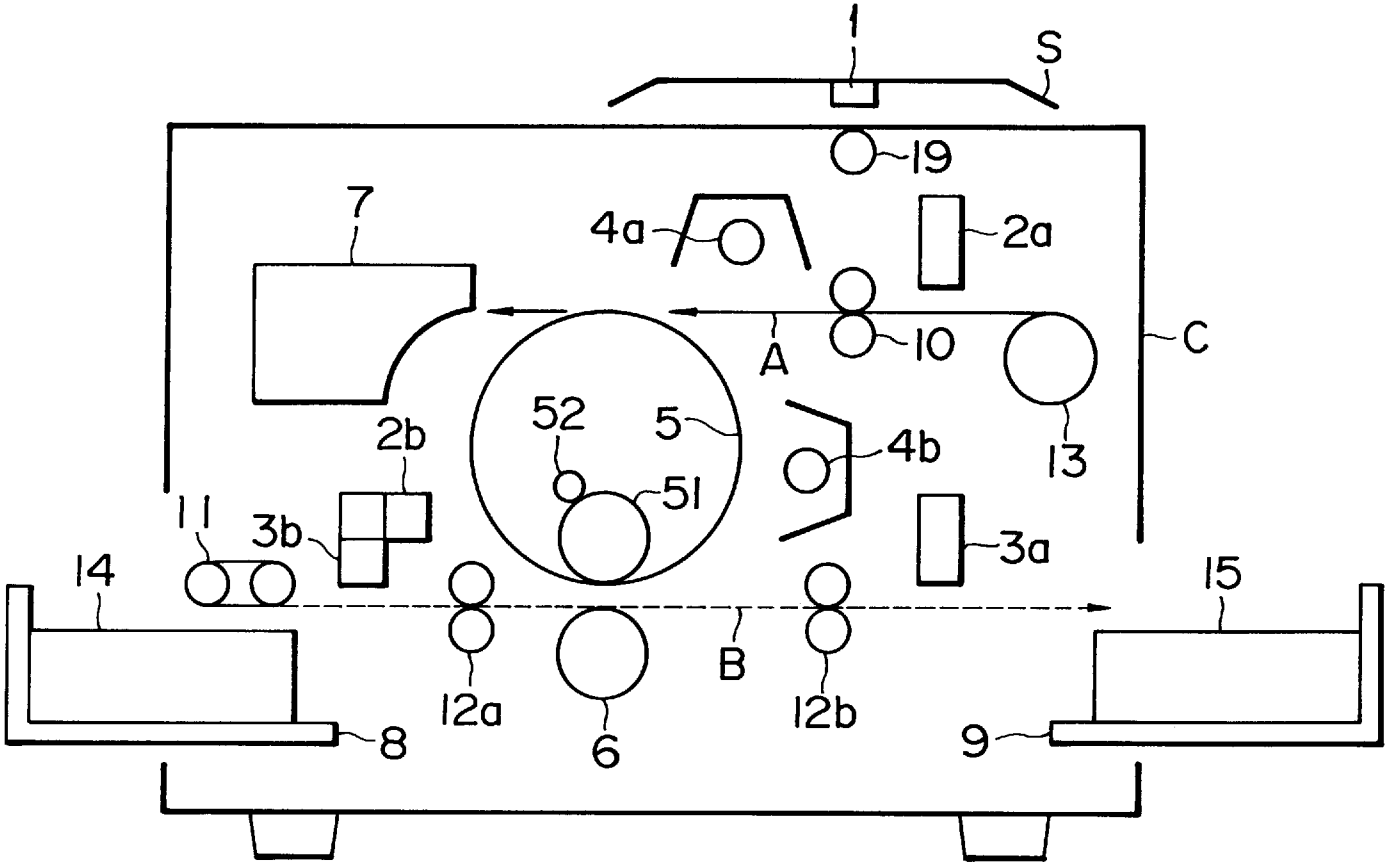
FIG. 2 is a side view of the printing apparatus illustrating an inner structure of an embodiment of the claimed printing machine.
Figure 3A:
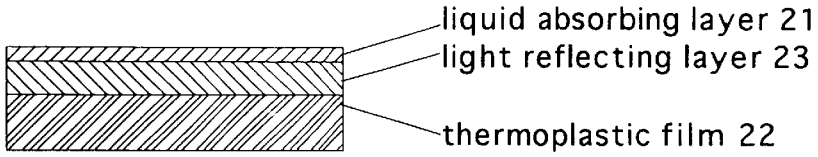
FIGS. 3A through 3D illustrate an alternative embodiment relating to perforating a substrate in which the reference numerals depict features described herein with respect to FIGS. 1A–1D and/or FIG. 2.
Figure 3B:
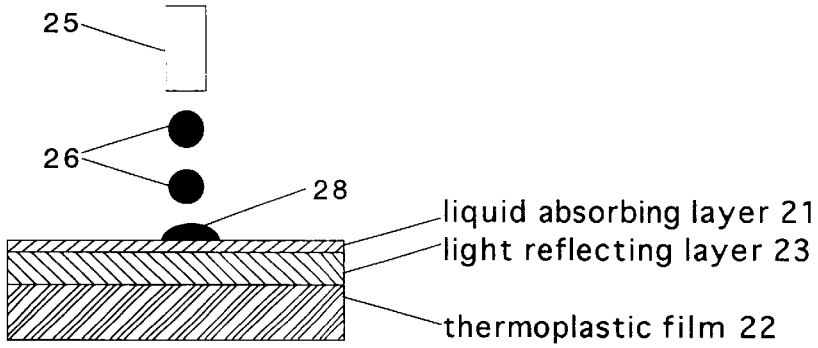
Figure 3C:
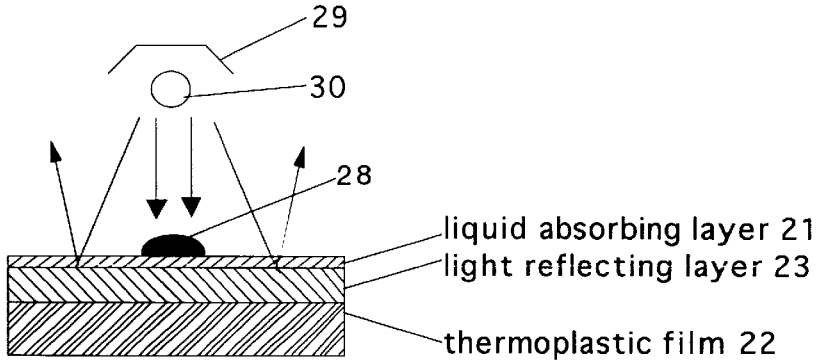
Figure 3D:
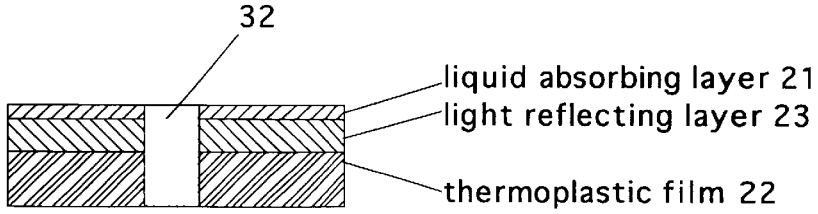

Another embodiment of the claimed printing apparatus is shown in FIG. 2.

FIG. 2 diagrams the inside structure of an embodiment of the present printing apparatus. The printing apparatus has a casing C in which a cylindrical printing drum 5 is disposed. The printing drum 5 has within a squeeze roller 51 which contacts the inner annular surface of the drum, and a doctor roller 52 which supplies the squeeze roller 51 with printing ink. A press roller 6, which can be raised and lowered to be attached to or detached from the circumferential surface of the printing drum 5, is disposed just below the printing drum 5 and opposite to the squeeze roller 51. Upon stencil printing, the printing drum 5 is rotated counterclockwise as seen in FIG. 2. A paper feeding tray 8 is disposed in the side wall of the casing C on the left side as seen in FIG. 2. Above the paper feeding tray 8, is disposed a paper feeding belt 11 which feeds individual pieces of printing paper 14 from the paper feeding tray 8 toward the printing drum 5. Adjacent to the paper feeding belt 11, are disposed paper feeding rollers 12*a* consisting of a pair of upper and lower rollers by which printing paper 14 that has been fed by the paper feeding belt 11 is further fed between the printing drum 5 and the press roller 6 in accordance with the timing of the rotation of the drum 5 upon printing. Also, paper discharging rollers 12*b* consisting of a pair of upper and lower rollers are disposed adjacent to the printing drum 5 on the right side as seen in FIG. 2. Paper 15 that has been printed between the printing drum 5 and the press roller 6 exits via the discharging rollers 12*b* and 15 conveyed to a paper discharging tray 9 disposed in the right side of the casing C as seen in FIG. 2.

As shown in FIG. 2, a cover S is disposed above the casing C. On the back side of the cover S, an image sensor 1 is mounted. An original feeding roller 19 is disposed opposite the image sensor 1 on the upper surface of the casing C, such that an original may be fed between the original feeding roller 19 and the image sensor 1 from the outside of the cover S to scan an image on the original and transform the desired image information into electrical signals. In the casing C, a roll of heat-sensitive 10 stencil sheeting 13 is placed below the original feeding roller 19 and supported on a suitable means for holding the roll permitting rotation about the axis thereof. To convey the stencil sheet therefrom toward the printing drum 5, stencil sheet feeding rollers 10 consisting of a pair of upper and lower rollers are disposed in the casing C. A stencil disposal box 7 into which used stencil sheet is discarded is disposed adjacent to the printing drum 5 on the side opposite the feeding rollers 10.

In order to achieve ejection of a photothermal conversion material to the stencil street according to the present invention, the liquid ejecting means may have, for example, an ejecting head 2*a* disposed adjacent to the way A on which stencil sheet 13 is fed to the printing drum 5 while the ejecting head 2*a* is directed to the stencil sheet 13 in the printing apparatus as shown in FIG. 2. Alternatively, the liquid ejecting means may have an ejecting means 2*b* disposed adjacent to the printing drum 5 while the ejecting head 2*b* is directed to the drum 5 as shown in FIG. 2.

In order to perforate the stencil sheet in the printing apparatus shown in FIG. 2, a light radiating means can be disposed, for example, adjacent to the way A on which stencil sheet 13 is fed to the printing drum 5, while being directed to the stencil sheet 13 as denoted by "4*a*" in FIG. 2. Alternatively, a light radiating means, which is directed to the printing drum 5 as denoted by "4*b*" in FIG. 2, may be disposed adjacent to the printing drum 5.

In addition, in order to print an image on printing paper 14 directly from the liquid ejecting means according to the present invention, a liquid ejecting means may have, for example, an ejecting head 3*a* disposed adjacent to the way B on which printing paper 14 is conveyed from the printing drum 5 downwardly to the discharging tray 15 while the ejecting head 3*a* is directed to printing paper as shown in FIG. 2. Alternatively, the liquid ejecting means may have an ejecting head 3*b* disposed adjacent to the way B on which printing paper 14 is conveyed from the feeding belt 11 to the printing drum 5 while the ejecting head 3*b* is directed to printing paper 14 as shown in FIG. 2.

In the priming apparatus shown in FIG. 2, the liquid ejecting means may have either one or both of ejecting heads 2*a* and 2*b* for perforating heat sensitive stencil sheet, and may have either one or both of ejecting heads 3*a* and 3*b* for effecting printing on priming paper directly therefrom. Alternatively, the liquid ejecting means may have a single ejecting head 2*b* which can turn to both the printing drum and the printing paper such that only the single head is sufficient for perforating a heat sensitive stencil sheet and effect printing on printing paper directly therefrom.

The printing apparatus shown in FIG. 2 can reproduce an image on a stencil sheet end priming paper by placing an original below the cover S, wherein the image sensor 1 scans an image of the original that is conveyed by the original feeding roller 19 so as to transform the image into electrical image information signals, end then controlling movement of ejecting heads relative to the stencil or printing paper as well as liquid ejection therefrom on the basis of the image information. Alternatively, an image may be reproduced by controlling the operation of ejecting heads directly by a personal computer (not shown) on the basis of image information which has previously been stored in the personal computer.

When a small number of copies are printed, the liquid ejecting means may be controlled such that the ejecting head denoted by 3*a* or 3*b* in the drawings ejects a liquid containing a colorant and/or a photothermal conversion material to reproduce an image directly on printing paper 14 that is being conveyed from the paper feeding tray 8 by the paper feeding belt 11 and the paper feeding rollers 12*a* and 12*b* while the printing drum 5 and the press roller 6 are detached from each other. Printing paper thus printed is stacked on the paper discharging tray 9 as printed paper 15.

When color printing is effected on printing paper 14, the liquid ejecting means may have a plurality of ejecting heads, each of which is controlled to eject each different color of ink on printing paper 14. For example, if each different color of a colorant is ejected from each of the ejecting heads 3*a* and 3*b*, printing in two colors are effected.

When a large number of copies are printed, the liquid ejecting means is controlled such that the ejecting head denoted as 2*a* in the drawings ejects a liquid containing a photothermal conversion material to reproduce an image on stencil sheet 13 that is being conveyed by the feeding rollers 10 toward the printing drum 5. Then, the stencil sheet 13 is exposed to a visible or infrared ray emitted from the light radiating means 4*a* to perforate the stencil sheet 13, and then is wound around the printing drum 5. Alternatively, the stencil sheet 13 may be first wound around the printing drum 5 and then exposed to a visible or infrared ray emitted from a light radiating means 4*b* to make perforations. Since the present invention can perforate a stencil sheet not contacting other materials, a stencil sheet 13 may be perforated by first winding it around the printing drum 5, controlling the liquid ejecting means to eject a liquid containing a photothermal conversion material from the ejecting head 2*b* to reproduce an image on the stencil sheet 13 that has been wound around the printing drum 5, and then radiating a visible or infrared ray from the light radiating means 4*b* to the wound stencil sheet 13.

Upon printing, the printing drum 5 which has been wound with the perforated stencil sheet 13 around the circumferential surface thereof, is rotated about the axis counterclockwise as seen in FIG. 2, and is simultaneously fed with stencil printing ink on its inner surface by the doctor roller 52 by way of the squeeze roller 51. Printing paper 14, which is being conveyed by the paper feeding belt 11 and the paper feeding roller 12*a* synchronously with the rotation of the printing drum 5, is brought into close contact with the printing drum 5 by the press roller 6 such that stencil printing ink is transferred through perforations of the stencil sheet 13 to the printing paper 14 to effect printing. Then, printing paper 14 thus printed is further conveyed by the paper discharging roller 12*b* to the paper discharging tray 9 and stacked thereon as printed paper 15.

In order to obtain a piece of paper which is printed with both stencil printing and direct printing by ejection of a colorant containing liquid, printing paper 14 is pressed by the press roller 6 to the printing drum to effect stencil printing and also printed directly by the ejecting head 3*a* or 3*b*. In this case, the liquid ejecting means may have a single ejecting head which can move to the position of the ejecting head 2*a* depicted in FIG. 2 upon stencil printing and move to the position of the ejecting head 3*a* depicted in FIG. 2 upon printing directly from the liquid ejecting means, or may have a rotatable single ejecting head which can turn to the printing drum 5 like the rejecting head 2*b* depicted in FIG. 2 upon stencil-printing and turn to printing paper 14 like the ejecting head 3*b* depicted in FIG. 2 upon printing directly from the liquid ejecting means.

However, when multicolor printing is effected, it is advantageous for the liquid ejecting means to have a plurality of ejecting heads. The order of printing in these two modes may be, for example, such that printing paper 14 is first printed in one of the two modes and stacked on the paper discharging tray 9 as primed paper 15, and then the printed paper 15 is again returned to the paper feeding tray 8 to print in the other mode, or that the direct printing is effected from the ejecting head 3*a* and/or the ejecting head 3*b* before and/or after printing paper 14 is stencil-printed by the printing drum 5. In the latter case, both the stencil printing and the direct printing can be effected during one step in which printing paper 14 is conveyed from the paper feeding tray 8 to the paper discharging tray 9.

The present invention does not require the stencil sheet to contact any substance such as an original and a thermal head. The stencil sheet simply need be exposed to a visible or an infrared ray, thus preventing the stencil sheet from wrinkling, when the stencil sheet is perforated.

According to the present invention, stencil printing can be effected when a large number of copies are printed, and the direct printing on printing sheets may be effected when a small number of copies are printed. As in the conventional rotary printing apparatus, the only sheets that must be installed in the present printing apparatus are a printing sheet and a heat-sensitive stencil sheet. Thus, the present printing apparatus may be small and can efficiently effect printing at relatively low operating cost.

According to the present invention, a combination of the two modes of direct printing and stencil printing makes possible overlaying printing and multicolor printing, and also makes printing in full color easier to achieve.

We claim:

1. A printing apparatus comprising:

(A) an ink-permeable cylindrical printing drum which is rotated about an axis of rotation thereof with a heat-sensitive stencil sheet wound around a circumferential surface thereof;

(B) a liquid ejecting means which ejects a photothermal conversion material contained in a liquid onto said heat-sensitive stencil sheet in accordance with image information, such that said photothermal conversion material is transferred to said heat-sensitive stencil sheet as a reproduction of a desired image;

(C) a light radiating means which radiates a visible or an infrared ray to said heat-sensitive stencil sheet to which said photothermal conversion material has been transferred, such that said heat-sensitive stencil sheet is perforated by heat emitted by said photothermal conversion material; and (D) a pressing means which presses at least either said printing drum or a printing sheet that is moving in synchrony with the rotation of said printing drum, bringing said printing drum and printing sheet into close contact with each other, such that a stencil printing ink that is fed into said printing drum is transferred to said printing sheet through said perforated stencil sheet;

wherein said liquid ejecting means is capable of further ejecting said photothermal conversion material and/or a colorant contained in a liquid directly to said printing sheet in accordance with said image information, such that said image can be reproduced directly on said printing sheet.

2. A printing apparatus as defined in claim 1, wherein said liquid ejecting means comprises a single ejecting head selectively directed to both said stencil sheet and said printing sheet to eject said photothermal conversion material to them.

3. A printing apparatus as defined in claim 1, wherein said liquid ejecting means comprises a plurality of ejecting heads which eject colorants to said printing sheet such that color printing is effected by ejecting a different color of colorant from each ejecting head.

4. A printing apparatus as defined in claim 1, wherein said heat-sensitive stencil sheet comprises a thermoplastic film and a liquid absorbing layer laminated to said thermoplastic film, said photothermal conversion material being ejected to said liquid absorbing layer, and said heat-sensitive sheet being perforated by perforation of said thermoplastic film with said light radiating means.

5. A printing apparatus as defined in claim 4, wherein said liquid absorbing layer is made of a resinous compound, and said heat-sensitive stencil sheet is perforated by perforation of said liquid absorbing layer and said thermoplastic film with said light radiating means.

6. A printing apparatus as defined in claim 4, wherein said liquid absorbing layer is laminated to a light reflecting layer which reflects said visible or infrared ray, wherein said reflecting layer is laminated to said thermoplastic film.

7. A printing apparatus as defined in any one of claims 4 to 6, wherein said heat-sensitive stencil sheet comprises a porous substrate which is laminated thereto on a side remote from said liquid absorbing layer.

* * * * *